US011415382B2

(12) United States Patent
MacNeill

(10) Patent No.: US 11,415,382 B2
(45) Date of Patent: Aug. 16, 2022

(54) FIREARM RELIABILITY SYSTEM

(71) Applicant: William MacNeill, Clovis, CA (US)

(72) Inventor: William MacNeill, Clovis, CA (US)

( * ) Notice: Subject to any disclaimer, the term of this patent is extended or adjusted under 35 U.S.C. 154(b) by 0 days.

(21) Appl. No.: 17/073,003

(22) Filed: Oct. 16, 2020

(65) Prior Publication Data

US 2021/0116192 A1 Apr. 22, 2021

Related U.S. Application Data

(60) Provisional application No. 63/012,647, filed on Apr. 20, 2020, provisional application No. 62/916,435, filed on Oct. 17, 2019.

(51) Int. Cl.

| | |
|---|---|
| ***F41A 3/72*** | (2006.01) |
| ***F41A 5/10*** | (2006.01) |
| ***F41A 3/56*** | (2006.01) |
| ***F41A 3/70*** | (2006.01) |
| ***F41A 3/84*** | (2006.01) |

(52) U.S. Cl.
CPC *F41A 3/72* (2013.01); *F41A 3/70* (2013.01); *F41A 3/84* (2013.01)

(58) Field of Classification Search
CPC .... F41A 3/72; F41A 3/56; F41A 35/00; F41A 9/55; F41A 9/56; F41C 27/00
See application file for complete search history.

(56) References Cited

U.S. PATENT DOCUMENTS

| | | | | |
|---|---|---|---|---|
| 4,297,800 | A * | 11/1981 | Atchisson | F41A 9/71 42/49.02 |
| 7,819,052 | B2 * | 10/2010 | Zedrosser | F41A 35/06 89/1.4 |
| 8,316,755 | B2 | 11/2012 | Overstreet et al. | |
| 8,453,367 | B2 * | 6/2013 | Overstreet | F41A 3/64 42/108 |
| 8,590,199 | B2 * | 11/2013 | Overstreet | F41A 3/36 42/69.02 |
| 2011/0252957 | A1 * | 10/2011 | Overstreet | F41A 33/00 89/128 |
| 2019/0277587 | A1 * | 9/2019 | Carimati Di Carimate | F41A 3/72 |

OTHER PUBLICATIONS

Rimfire Perfected, 22lr AR Reliability Kit, Nov. 20, 2020, https://borebuddy.com/product/reliability-kit/(Year: 2020).*

* cited by examiner

*Primary Examiner* — Derrick R Morgan
(74) *Attorney, Agent, or Firm* — Klemchuk LLP

(57) ABSTRACT

A firearm reliability system may include a charging handle insert and a variable bolt weight assembly. Other components of a firearm reliability system may include, but are not limited to, a buffer pressure plug, extractor springs, firing pin springs, one or more firing pins, and bolt buffers. The firearm reliability system may address weaknesses in the common rimfire AR bolt system. Using the firearm reliability system, malfunctions may be essentially eliminated. Each component of the firearm reliability system plays a part and interfaces with the others (i.e., the bolt weight spreads the impact on the buffer into a larger area, while reducing the speed at which the bolt impacts the backplate, which then reduces the energy transferred to the buffer pressure plug and thus the impact with the lower receiver).

20 Claims, 9 Drawing Sheets

FIREARM RELIABILITY SYSTEM

CROSS REFERENCE TO RELATED APPLICATIONS

This application claims the benefit under 35 U.S.C. § 119(e) of U.S. Provisional Patent Application Ser. No. 62/916,435 filed on Oct. 17, 2019, entitled "Charging Handle Insert" and U.S. Provisional Patent Application Ser. No. 63/012,647 filed on Apr. 20, 2020, entitled "Variable Bolt Weight Assembly," both of which are incorporated by reference in their entirety.

FIELD OF THE DISCLOSURE

The present disclosure generally relates to firearm reliability, and more particularly to firearm reliability systems including a charging handle insert and a variable bolt weight assembly.

BACKGROUND

Various factors can affect firearm reliability. For example, a firing cycle for a firearm, such as an AR-15, may be affected by the cyclic rate, i.e., how fast the bolt opens and closes after a shot is fired. If the cyclic rate is too fast, the action may jam the magazine, the extractor may lose its grip on the rim, or the bolt may catch the casing before it can eject. If it is too slow, there may not be enough force to extract the casing or it may not open far enough to eject a fired casing. There also may inconsistent seating (and positioning) of the chamber adapter relative to the rifle's chamber and/or bouncing of the chamber adapter assembly during firing. Further, casings can get caught in the charging handle.

SUMMARY

Embodiments of the present disclosure may provide a firearm reliability system comprising: a charging handle insert (CHI) that may increase cycling reliability by preventing rimfire casings from getting caught in a charging handle and deflecting gas away from a shooter during firing; and a variable bolt weight assembly (VBWA) that may slip under a spring guide rod extension of a bolt assembly and contact a back of a bolt. The VBWA may contact the back of the bolt near a firing pin and/or may contact the back of the bolt on a keyed area on a back of the spring guide rod extension. The system may be used with a dedicated rimfire firearm. The system may be used with a centerfire firearm with a chamber adapter style rimfire conversion kit installed, and the CHI may fill a gas key channel in a centerfire charging handle (CCH) to prevent malfunctions from empty rimfire casings that become lodged in the gas key channel. The system also may include a buffer pressure plug that may increase cycling reliability by applying steady forward pressure to a back plate of a rimfire bolt carrier, bolt, and chamber adapter assembly; and a buffer spring, wherein the buffer pressure plug may compress the buffer spring to add extra pressure to the back plate of the rimfire bolt carrier, bolt, and chamber adapter assembly. The buffer pressure plug may include a retention slot in which a buffer pin rests to keep the buffer pressure plug aligned; and an insertion slot disposed along a length of a cylinder of the buffer pressure plug, the insertion aligned with the buffer pin and pushed straight rearward to insert. The system also may include a bolt buffer including a hole that may receive a spring guide rod and a tab that may interface with a cutout on the back plate of the rimfire bolt carrier, bolt, and chamber adapter assembly. The system may further include a modified collar that may lock a chamber adapter into the modified collar, thereby allowing a dedicated rimfire group to be used in a centerfire gun through the chamber adapter that may be inserted and locked in and removed for use in a dedicated rimfire rifle. The system also may include a polymer buffer that may serve as a bolt impact point, the polymer buffer including tabs that may slide into corresponding grooves on a collar, wherein the polymer buffer may eliminate noise of metal-on-metal between the bolt and the collar.

Other embodiments of the present disclosure may provide a firearm reliability system comprising: a charging handle insert (CHI) that may increase cycling reliability by preventing rimfire casings from getting caught in a charging handle and deflecting gas away from a shooter during firing, the CCH comprising: a semi-cylindrical lower profile that may match a semi-cylindrical profile of a gas key channel of a charging handle; gas deflection cutouts that may redirect gas from an open gas tube and block an open channel leading back toward a shooter; and a center channel that may retain the CHI inside of a plurality of charging handle types. The CHI may further comprise retention ramps on either side of the center channel to enhance friction between the CHI and walls of the gas key channel of the charging handle. In a conversion kit configuration in a centerfire rifle, a gas tube may connect to a rifle's bore forward of a chamber and interface a centerfire bolt group to cycle the action by utilizing high pressure gas from behind a bullet during firing. In a centerfire configuration, high pressure gas may unlock a bolt and push the bolt rearward to cycle action. In a rimfire conversion configuration, a gas tube may be connected to a rifle bore and high-pressure gas may be bled off but may not be used to cycle the firearm.

Further embodiments of the present disclosure may provide a firearm reliability system comprising: a variable bolt weight assembly (VBWA) that may slip under a spring guide rod extension of a bolt assembly and contact a back of a bolt, wherein a weight body of the VBWA is behind a bolt as it closes to eliminate bolt bounce with two impacts. The two impacts are the weight body to the rearward moving bolt and internal weights of the VBWA to the rearward moving bolt and a bolt body. The back of the bolt may include a notch that engages a notch present on the spring guide rod extension of the bolt assembly. The VBWA may contact the back of the bolt near a firing pin and/or the VBWA may contact the back of the bolt on a keyed area on a back of the spring guide rod extension.

Other technical features may be readily apparent to one skilled in the art from the following figures, descriptions and claims.

BRIEF DESCRIPTION OF THE DRAWINGS

For a more complete understanding of this disclosure, reference is now made to the following description, taken in conjunction with the accompanying drawings, in which.

DETAILED DESCRIPTION

Figure 1:
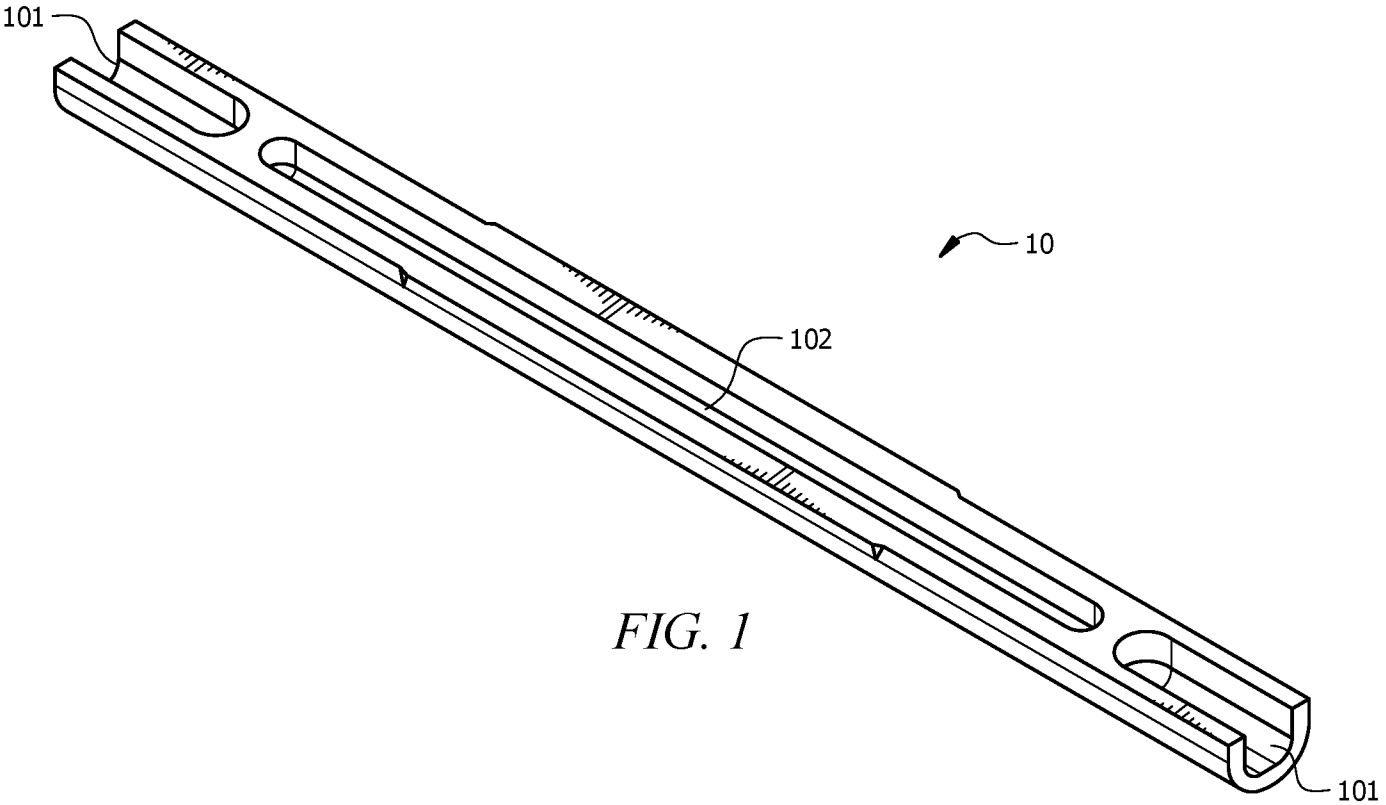
FIG. 1 depicts a charging handle insert according to an embodiment of the present disclosure.

Embodiments of the present disclosure may provide a firearm reliability system that may include a charging handle insert and a variable bolt weight assembly. Other components of a firearm reliability system may include, but are not limited to, a buffer pressure plug, extractor springs, firing pin springs, one or more firing pins, bolt buffers, and collars as described in more detail herein. The firearm reliability system according to embodiments of the present disclosure may address one or more weaknesses in the common Ciener/Atchisson style rimfire bolt system (RBS) for the ArmaLite Rifle (AR) that is known to be prone to frequent malfunctions. With the firearm reliability system according to embodiments of the present disclosure installed, malfunctions may be essentially eliminated from the system. Each component of the firearm reliability system according to embodiments of the present disclosure plays a part and interfaces with the others (i.e., the bolt weight may spread the impact on the buffer into a larger area, while reducing the speed at which the bolt impacts the backplate, which then may reduce the energy transferred to the buffer pressure plug and thus, the impact with the lower receiver).

A charging handle insert (hereafter CHI) according to embodiments of the present disclosure may increase cycling reliability by preventing rimfire casings from getting caught in the charging handle and to deflect gas away from the shooter during firing. The CHI according to embodiments of the present disclosure may allow the shooter to train using his/her normal charging handle while still getting the reliability and gas deflection benefits of a rimfire-specific charging handle. The CHI may press into the gas key channel of a centerfire charging handle (hereafter CCH) of an ArmaLite Rifle pattern firearm. The CHI may be retained in the channel of the CCH by friction between the sides of the CHI and CCH channel.

The CHI can be used with either a dedicated rimfire firearm or centerfire firearm with a chamber adapter style rimfire conversion kit installed. In a dedicated rimfire firearm, the CHI may fill the gas key channel in the CCH to prevent malfunctions from empty rimfire casings that may become lodged in the CCH gas key channel. In a centerfire firearm with a rimfire conversion, the CHI may fill the gas key channel in the CCH to prevent malfunctions from empty rimfire casings that may become lodged in the CCH gas key channel. In this application, the CHI also may reduce gas blowback towards the shooter. The gas has two primary sources: 1) gas leakage through the gap between the centerfire chamber and the rimfire chamber adapter and 2) gas from the open gas tube which points rearward within the CCH gas key channel. Without the gas key of the centerfire bolt carrier group, gas escaping from the gas tube during firing travels without obstruction down the CCH gas key channel towards the operator. The CHI may block the flow of gas and a gas deflection feature may redirect the gas downward. This may reduce or eliminate gas blowback through the gas key channel. The CHI may be symmetrical to avoid orientation mistakes when inserting into the CCH and may be manufactured from polymer or metal by additive, subtractive, or molding manufacturing processes.

FIG. 1 depicts CHI 10 according to an embodiment of the present disclosure. CHI 10 may be compatible with all standard charging handles in embodiments of the present disclosure. In a conversion kit configuration in a centerfire rifle, a gas tube may connect to the rifle's bore forward of the chamber and that tube may interface with the centerfire bolt group to cycle the action by utilizing high pressure gas from behind the bullet during firing. In a centerfire configuration, that high pressure gas unlocks the bolt and pushes the bolt rearward, thereby cycling the action. In a rimfire conversion configuration, the gas tube is connected to the rifle's bore and the high pressure gas is still bled off, but is not used to cycle the firearm since the RBS is purely a blowback system—there is no lockup of bolt to barrel and the recoil of the cartridge moves the bolt. The gas may vent directly into the charging handle (rather than being directed into the bolt carrier as in a centerfire configuration) and flow back towards the shooter, which is highly undesirable. CHI 10 may block that gas, reducing what is felt by the shooter, and catching fouling in the cutouts.

Figure 2:
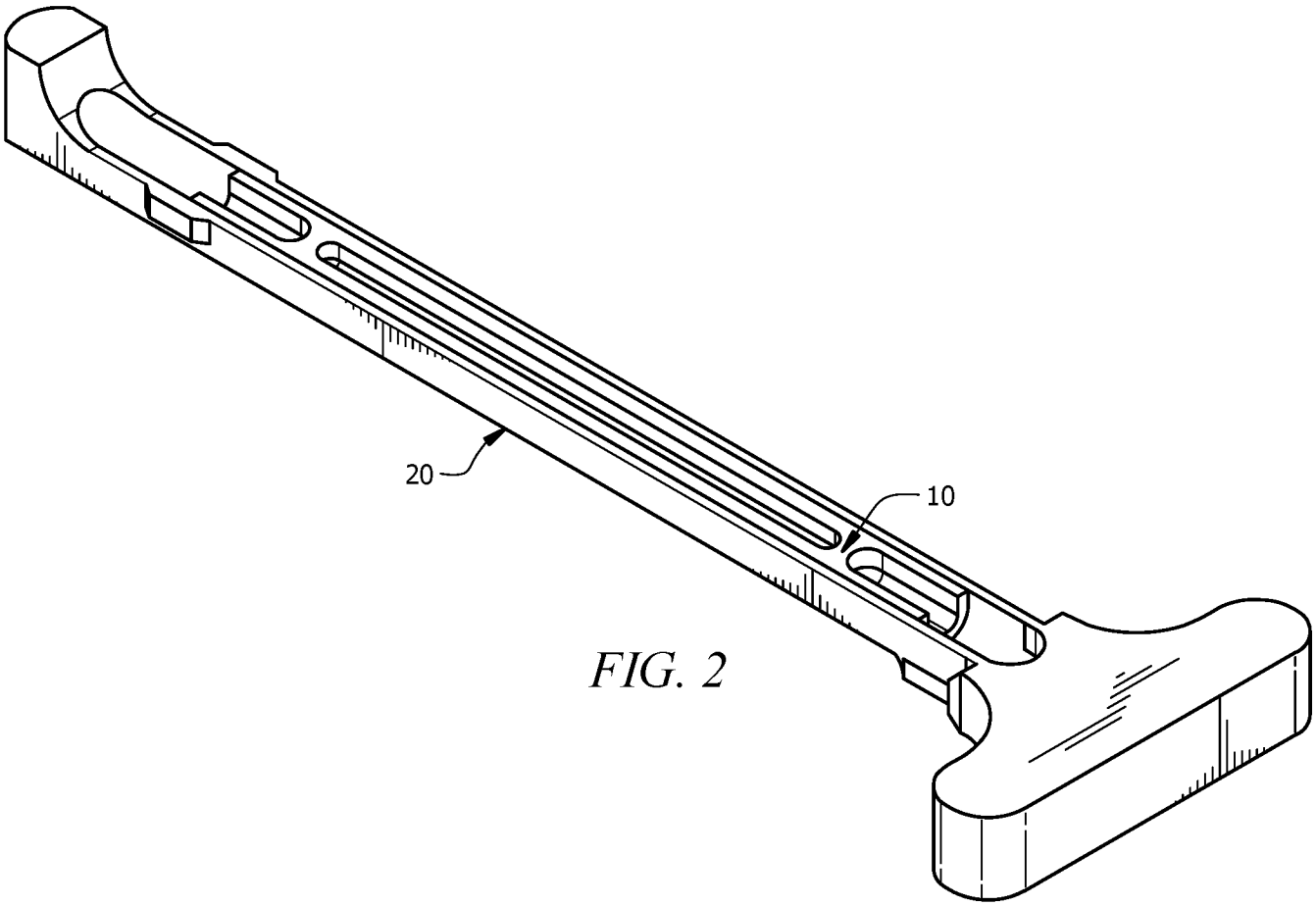
FIG. 2 depicts the charging handle insert of FIG. 1 installed in a centerfire charging handle according to an embodiment of the present disclosure.

CHI 10 features gas deflection cutouts to redirect gas from the open gas tube and block the open channel leading back towards the shooter, reducing the puff of gas felt when shooting a rimfire conversion kit in a centerfire rifle. CHI 10 may include a semi-cylindrical lower profile to match the semi-cylindrical profile of a gas key channel of CCH 20 (FIG. 2). There may be two gas deflection cuts (one on either end to allow CHI 10 to be installed in either direction), and there may be two retention ramps 101 on either side of center channel 102 to enhance friction between CHI 10 and the walls of CCH 20 gas key channel. Center channel 202 may make CHI 10 a universal fit, permitting the walls of CHI 10 to flex sufficiently to provide tension on retention ramps 101 to retain CHI 10 inside of a variety of CCH types, accounting for variations in manufacturing tolerances and slight dimensional variations.

FIG. 2 depicts CHI 10 of FIG. 1 installed in CCH 20 according to an embodiment of the present disclosure. To install, either end of CHI 10 may be aligned with the center of the front tabs and then pressed firmly into CCH 20. It should be appreciated that in an embodiment of the present disclosure, CHI 10 should sit about 0.030" below the bottom surface of CCH 20. However, it may sit lower or higher relative to the bottom surface of CCH 20 without departing from the present disclosure. CHI 10 may be removed by prying from the back edge or sliding CHI 10 rearward in CCH 20 to release CHI 10 in an embodiment of the present disclosure.

Figure 6:
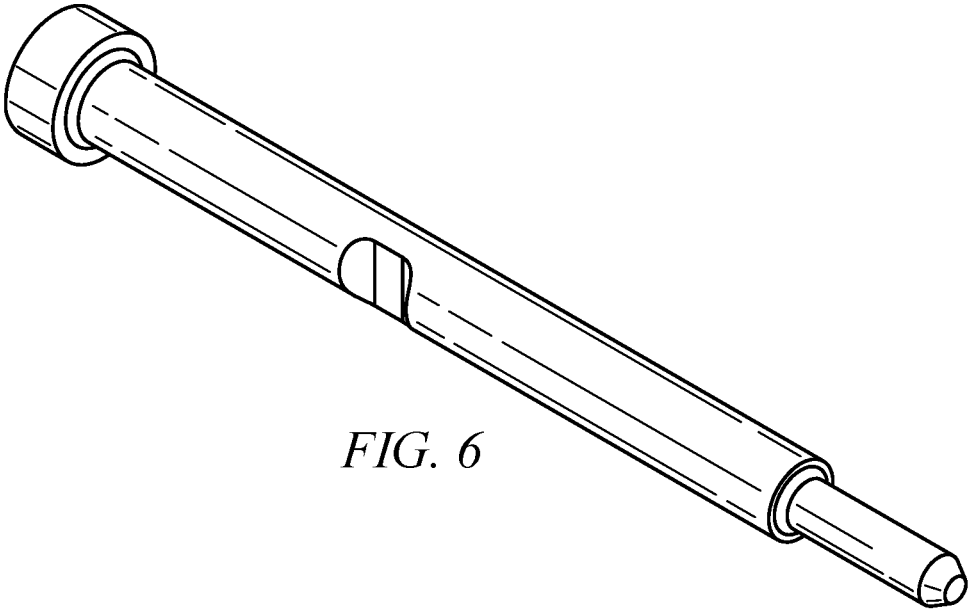
FIG. 6 depicts a firing pin according to an embodiment of the present disclosure.
Figure 8A:
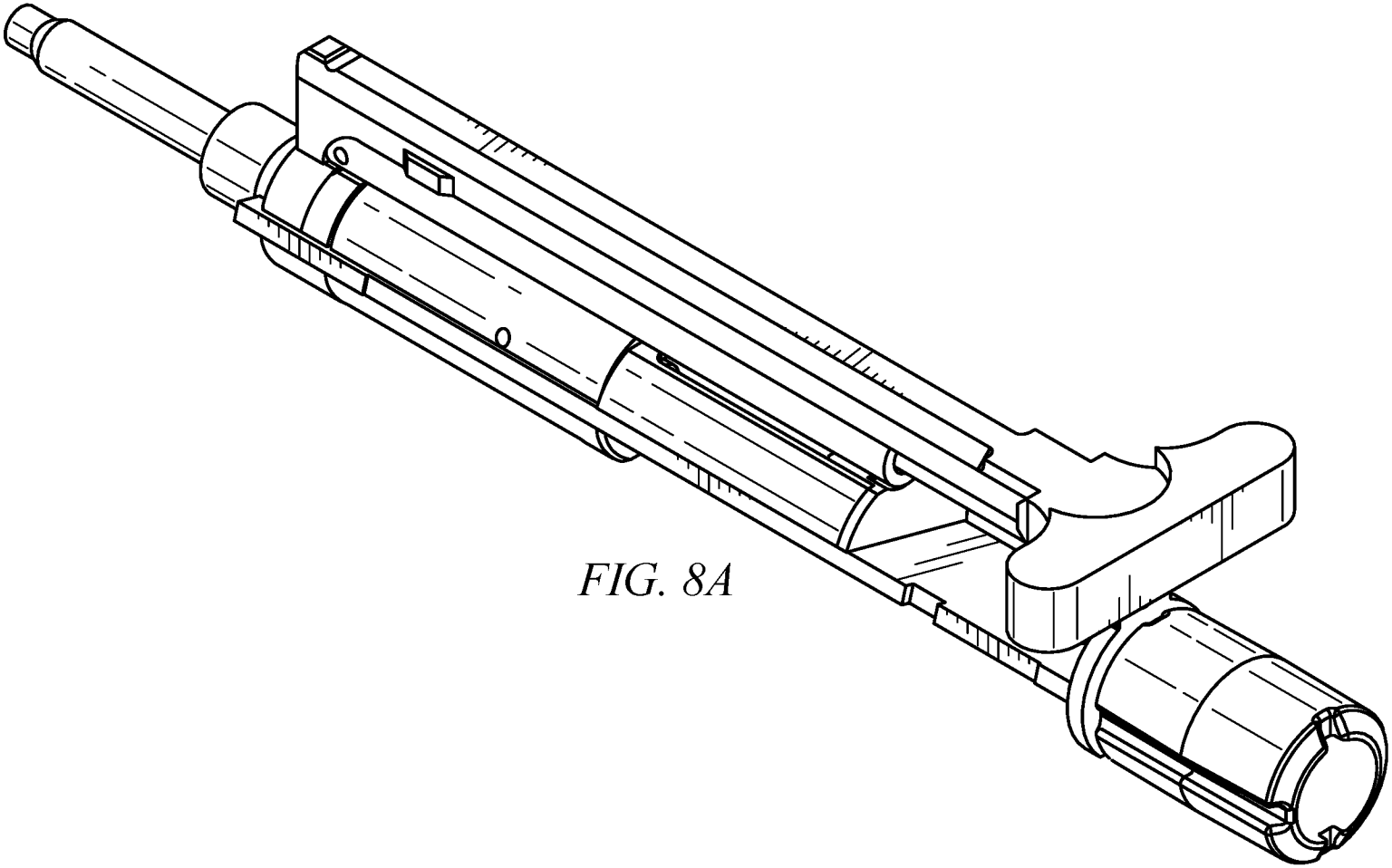
FIG. 8A depicts a bolt assembly according to an embodiment of the present disclosure.
Figure 8B:
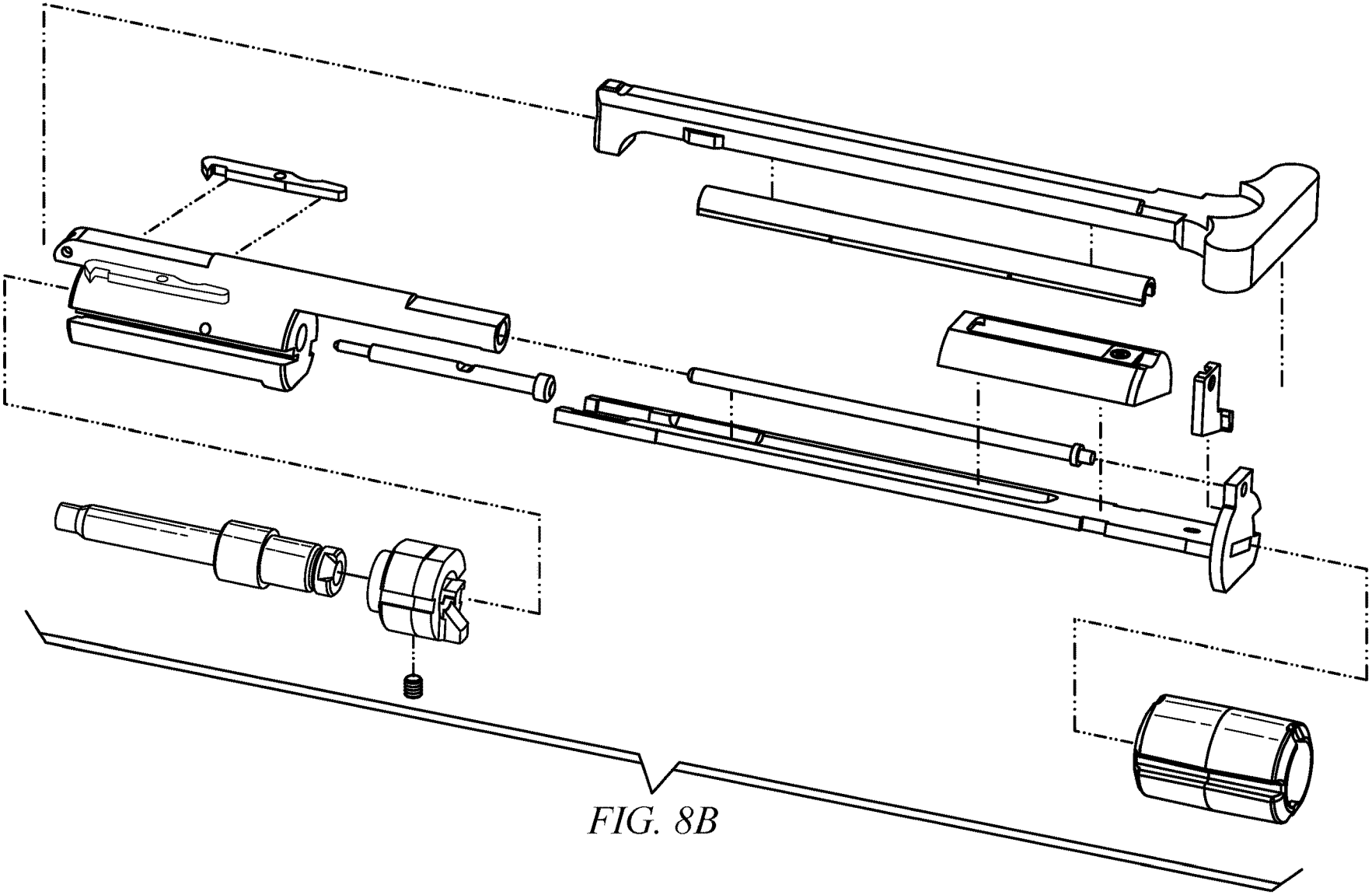
FIG. 8B depicts an exploded view of the bolt assembly of FIG. 8A according to an embodiment of the present disclosure.
Figure 9A:
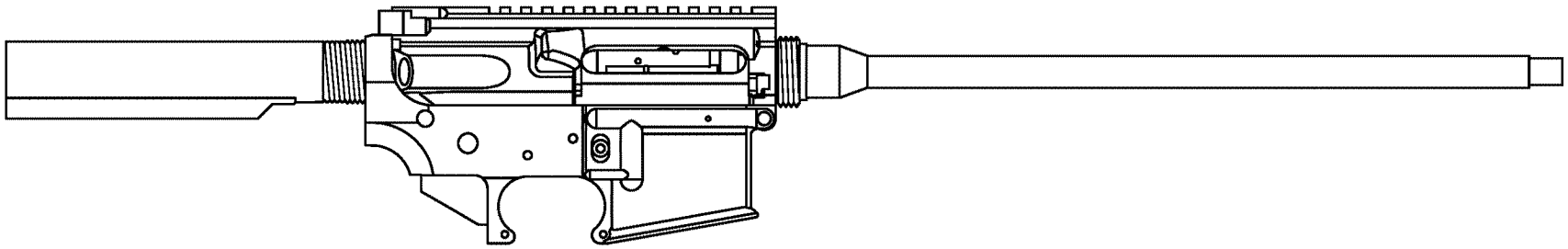
FIG. 9A depicts a master assembly according to an embodiment of the present disclosure.
Figure 9B:
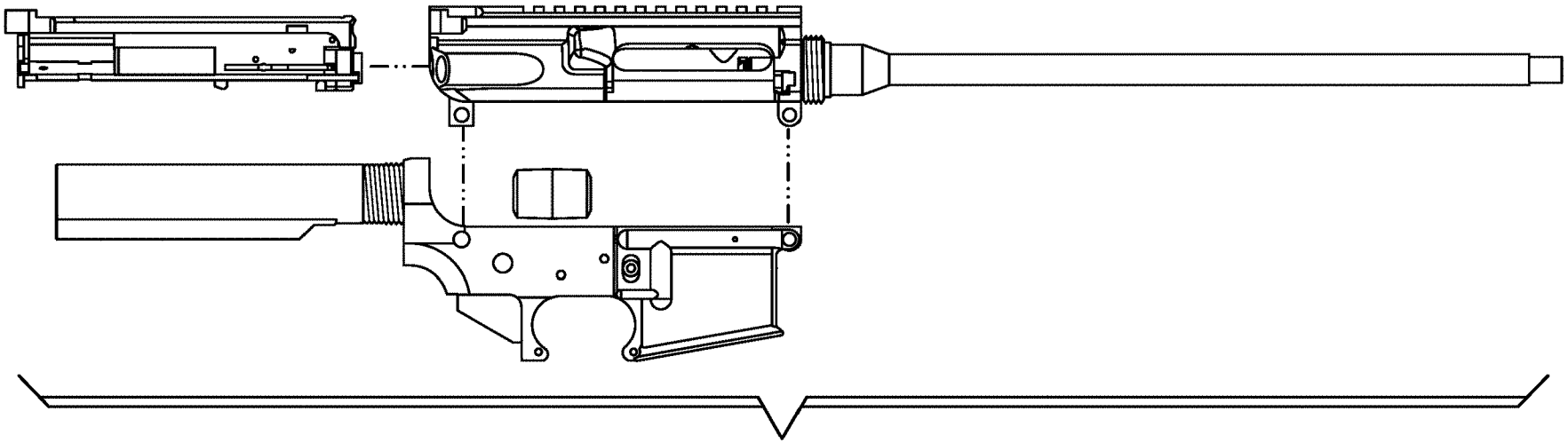
FIG. 9B depicts an exploded view of the master assembly of FIG. 9A according to an embodiment of the present disclosure.

Embodiments of the present disclosure may provide a variable bolt weight assembly (hereafter VBWA) that may add user variable mass to an AR rimfire bolt assembly found in most rimfire AR rifles. The VBWA may slip under the spring guide rod extension of the bolt assembly (FIGS. 8A-8B) and contact the back of the bolt near the firing pin (FIG. 6) and/or the keyed area on the back of the Tubular recoil spring housing. The VBWA according to embodiments of the present disclosure can be used with either a dedicated rimfire firearm or centerfire firearm with a chamber adapter style rimfire conversion kit installed. A conversion kit bolt may be used in connection with a barrel chambered in a centerfire cartridge to convert it to fire rimfire ammunition. It accomplishes this through the use of a chamber adapter (that is smoothbore with no rifling) that may fit into the centerfire chamber. A dedicated rimfire upper may be used for rifles chambered in rimfire cartridges. There is no adapter, but instead there is a barrel collar (FIGS. 11A-11C) that may be retained to the barrel by use of the ball spring plunger that may interface with a groove in the barrel.

Rimfire ammunition spans a large spectrum in terms of the energy generated by the cartridge. In commonly available 22LR cartridges, bullet weights vary from 30 to 60 grains with velocities ranging from 700 to 1700 feet per second. As such, the bolt thrust and thus bolt velocity in a pure blowback operated semi-automatic rifle can vary significantly. To create reliable and safe operation, the bolt mass must be matched to the energy generated by a specific load. In a rimfire AR pattern firearm, the bolt mass is fixed and unable to be tuned by the user for each load. Often, the mass is far too low, and excessive bolt velocity may be observed. The VBWA may be inserted behind the bolt in an AR pattern rimfire action and add mass to the system to allow the user to tune the rifle to the specific load for perfect cycling and control of excessive bolt velocity. The user can remove the back plate from the VBWA by removal of screw(s) to access the weight inserts. Inserts of different materials ranging from very light polymers to tungsten can be installed in various combinations to precisely add or remove weight from the system, thus tuning the bolt for any load across a large number of available rimfire loadings and rimfire cartridges.

The VBWA according to embodiments of the present disclosure may provide an assembly with the parts provided to allow the user to vary the weight by small increments by adding or removing weights of different materials and densities. A simplified monolithic VBWA may add a fixed weight to the system that is intended to fit the largest number of loadings possible without the added part count and thus cost and complexity of the VBWA. The simplified weight and the individual parts comprising the VBWA according to embodiments of the present disclosure may be manufactured from metal or polymer by additive, subtractive, or molding manufacturing processes.

In embodiments of the present disclosure, the VBWA may include internal weights made from aluminum, steel, and tungsten which may be used to adjust the weight from approximately 1 oz to 3 oz, depending on the internal weight types used. Mixing and matching material types may give additional variability. The weight system may be tuned by starting with the weight in a low-weight configuration and adding weight until performance of the system is optimized and last round bolt hold open is reliable. If last round bolt hold open is not achieved, the bolt weight should be reduced. It should be appreciated that each hole should always be either completely empty or contain two weights; only one weight should not be installed.

The main purpose of a bolt weight is to eliminate bolt bounce in the system. The two types of weights both do this, but the adjustable weight may be preferred in embodiments of the present disclosure as the sliding internal weights may provide a second degree of damping to the bounce. When the bolt closes chambering a round and impacts the bolt collar, it bounces off With an adjustable weight, the weight body is a small distance behind the bolt as it closes, which eliminates some of the bolt bounce by impacting the rearward traveling bolt (after it bounces off the collar) and slowing the rearward motion. Any rearward motion that is still happening is stopped when the internal weights then slide forward, impacting the front of the holes inside the weight, stopping more rearward motion. With a "standard" weight, there is one impact (weight to bouncing, rearward moving bolt). With an "adjustable" weight, there are two impacts: the weight body to bouncing, rearward moving bolt followed by the internal weights to the rearward moving bolt and bolt body. The different materials allow for the user to tune the weight of the bolt weight to a weight which still allows the rifle action to cycle (too much weight will stop cycling), as well as tune the amount of secondary impact from the internal weights to reduce bolt bounce to an acceptable level.

Secondarily, it adds weight to a bolt that is very much underweight (as compared to other blowback rimfire platforms) which drops bolt velocity, reducing overall wear on the rifle. This also holds the bolt closed slightly longer, allowing for more of the powder to burn while the casing is in the chamber and allowing pressure in the chamber and bore to drop before the casing is extracted. This reduces fouling inside the rifle's action (from the reduction in gas and unburned powder that are otherwise released when the case is extracted prematurely) and reduces sound (known colloquially as "port pop") from expanding gasses released from the breech when casing extraction is premature. Reducing port pop makes the rifle quieter to the shooter, especially when a suppressor is in use. When used in a full auto rifle, the elimination of bolt bounce makes full auto fire reliable. The bolt bouncing would often result in stoppages since the hammer would hit the rebounding bolt rather than the firing pin, which at best would cause the rifle to stop firing and have a dead trigger (hammer down on a loaded chamber) or at worst for the hammer to set the cartridge off out of battery, resulting in a casing rupture and potential damage to the rifle or injury to the shooter.

A bolt weight assembly may slip under the tubular recoil spring housing, and the notch on the back of the bolt may engage a notch present on the tubular recoil spring housing. There may be some play in the bolt weight fit due to variations in the bolt assembly, but this will not harm the performance of the bolt weight. It should be appreciated that some users find it easier to depress the firing pin by hand and slide the weight directly in, while others may find it easier to put the front of the weight in place and then rotate the back of the weight under the tubular recoil spring housing until the notch is engaged.

Extractor springs may be provided in two different strengths for better extraction especially as the chamber becomes fouled. To install, the extractor pin out may be driven from top to bottom, and the extractor and spring may be removed. The spring may be replaced with an increased power extractor spring, the hole may be aligned in the bolt and extractor, and the pin may be reinserted. The heavier extractor springs may increase extraction reliability and also may help with a more consistent ejection pattern, which may further reduce the possibility of malfunctions.

Figure 3:
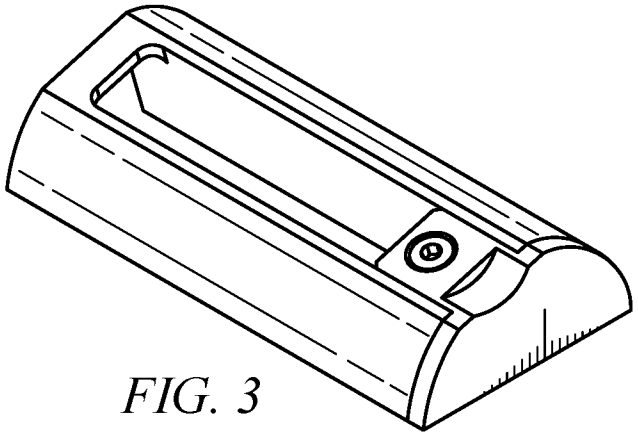
FIG. 3 depicts an assembled variable bolt weight assembly (VBWA) according to an embodiment of the present disclosure.
Figure 4:
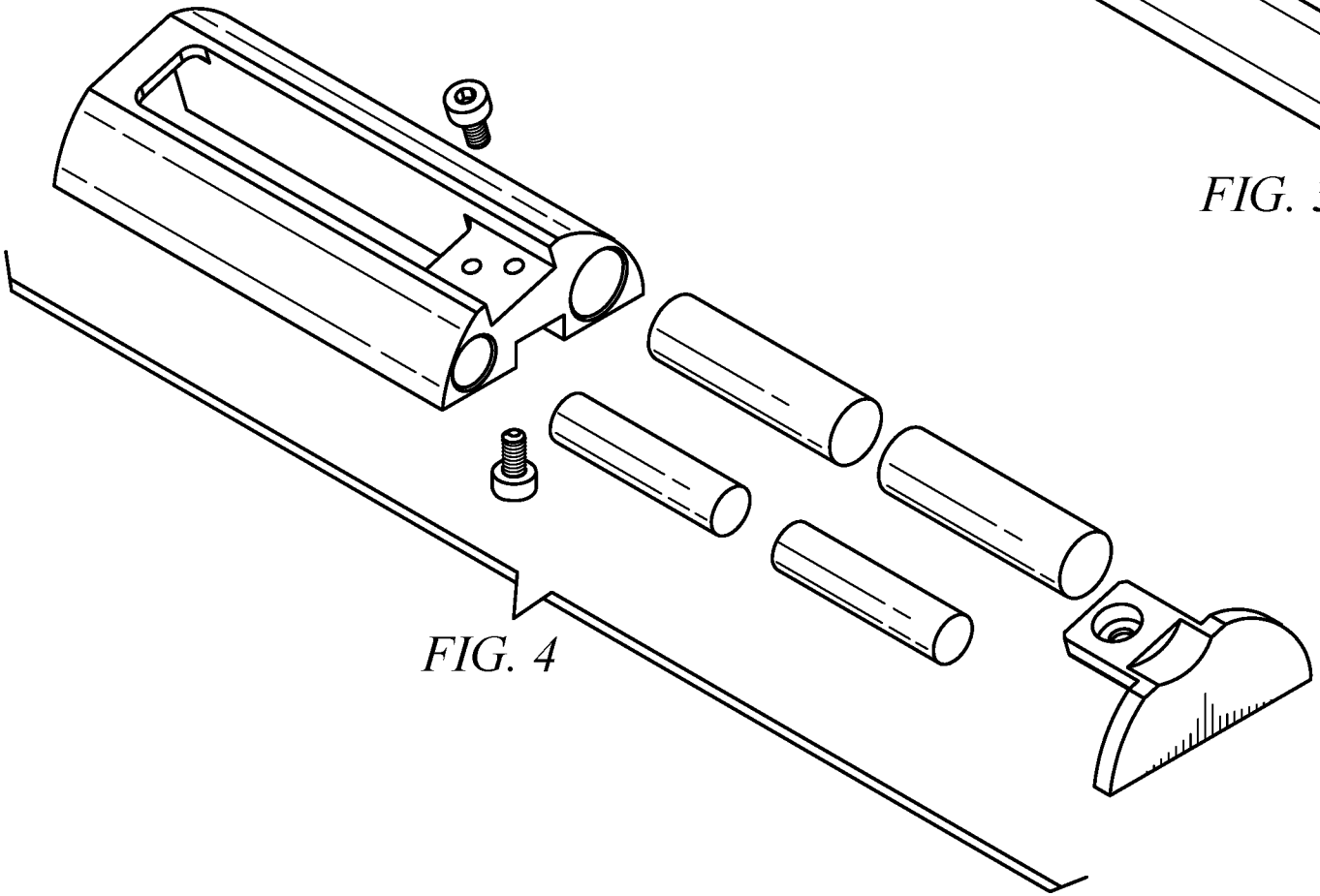
FIG. 4 depicts an exploded view of the VBWA of FIG. 3 with the weight inserts visible according to an embodiment of the present disclosure.

FIG. 3 depicts an assembled view of the VBWA according to an embodiment of the present disclosure. The VBWA may include a main body which contains cavities for weight inserts. The back plate may be affixed to the body by machine screws and may securely contain the weight inserts. FIG. 4 depicts an exploded view of the VBWA with the weight inserts visible according to an embodiment of the present disclosure. It should be appreciated that there may be a simplified version of the VBWA that may reduce complexity to integrate all components of the VBWA into a monolithic part that can be more easily and cost effectively produced by machining, casting or metal injection molding or other manufacturing techniques.

Figure 5:
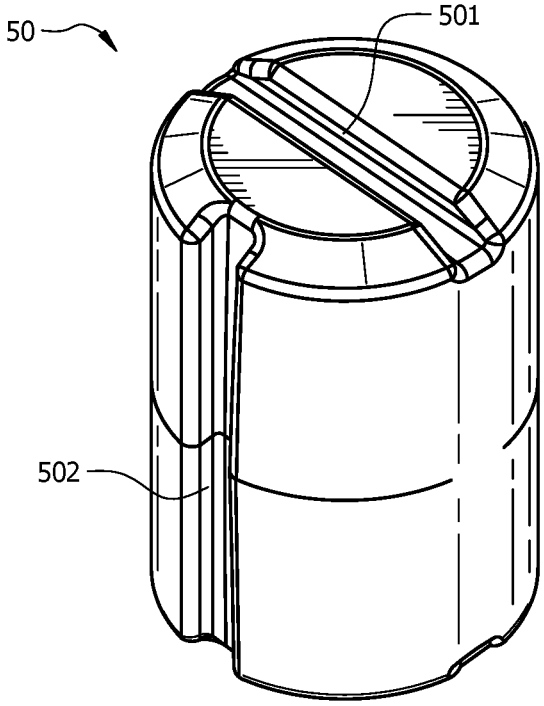
FIG. 5 depicts a buffer pressure plug according to an embodiment of the present disclosure.
Figure 10:
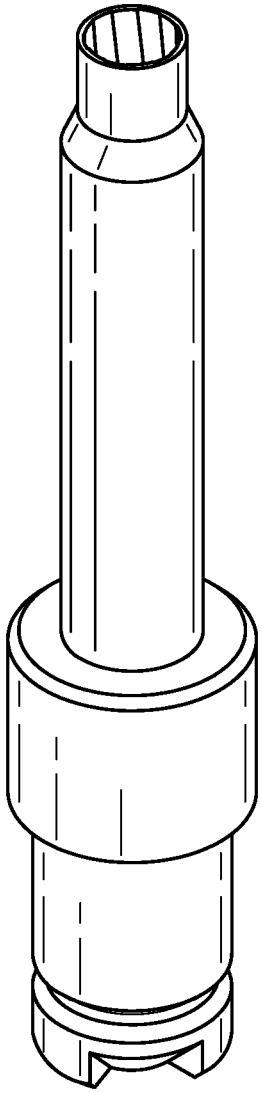
FIG. 10 depicts a rifled chamber adapter according to an embodiment of the present disclosure.

FIG. 5 depicts buffer pressure plug 50 according to an embodiment of the present disclosure. Buffer pressure plug 50 may increase cycling reliability by applying steady forward pressure to the back plate of a rimfire bolt carrier, bolt, and chamber adapter assembly. This increased reliability may be attributable to factors including, but not limited to, 1) the pressure resulting in more consistent seating (and thus positioning) of the chamber adapter (FIG. 10) to the rifle's chamber and 2) the pressure minimizing bouncing of the assembly during firing. Buffer pressure plug 50 may compress the buffer spring by approximately 40 mm in an embodiment of the present disclosure, which may add extra pressure to the backplate of the bolt assembly. This may improve reliability as stated above and also may reduce or eliminate damage to the lower receiver. The bolt buffer (FIG. 7) also may soften the impact that causes marks on the lower receiver because of the bolt assembly being forced rearward when firing. The upper portion of the bolt group backplate may slam into the top of the lower receiver above the buffer tube. Buffer pressure plug 50 putting pressure on the back of the bolt may keep everything seated more tightly, which also may reduce fouling when using a chamber adapter (FIG. 10) for use in a centerfire rifle. With a chamber adapter conversion bolt, the movement rearward results in misalignment and a gap between the adapter and bore, which results in rapid fouling and leading of the bore, chamber and adapter.

Buffer pressure plug 50 may include retention slot 501 in which the buffer pin may rest to keep plug 50 aligned. Retention slot 501 may also allow use of a coin, flat blade screwdriver, or other similar object to be used to twist plug 50 for insertion or removal. Insertion slot 502 disposed along the length of the cylinder of plug 50 may allow quick and easy insertion without a need to depress the buffer retaining pin. Insertion slot 502 may be aligned with the buffer retention pin and then may be pushed straight rearward to insert.

Plug 50 may be inserted by pulling the rear takedown pin and hinge the upper receiver away from the lower receiver. Insertion slot 502 may be aligned with the buffer retainer pin, pressed straight back, and plug 50 may be twisted ¼ turn in either direction to allow the buffer pin to drop into retention slot 501. Plug 50 can be inserted either direction, but in embodiment of the present disclosure, the hollow side may be inserted towards the buffer. The upper receiver may be closed, and the rear takedown pin may be replaced. Removal is the reverse of installation. On some buffer springs, the spring may become preloaded from twisting plug 50 ¼ turn. While this does not cause damage or affect the function of plug 50, some users find it useful to turn plug 50 ½ turn and then back ¼ turn to remove the rotational preload of the buffer spring. While most rifles will allow plug 50 to be rotated with ease, if difficulty is encountered, use a coin in the retention slot to help with turning plug 50.

A firing pin spring may be installed on a narrow end of a firing pin (FIG. 6) according to an embodiment of the present disclosure. The firing pin retainer pin may be removed so that the firing pin may fall free from the assembly. The old firing pin spring may also fall free, or it may have to be pushed out. A stuck spring can usually be dislodged by inserting a pick or similar small diameter object through the firing pin hole and pushing it out towards the rear of the bolt. It can also be fished out from the back in a similar manner. The firing pin channel should be clear of debris and fouling before installation. The new spring may be placed on the end of the firing pin, both may be inserted into the bolt, the retaining pin may be replaced.

A firing pin according to an embodiment of the present disclosure (FIG. 6) may install in a similar manner to a stock pin. The firing pin retaining cotter pin may be pulled, the firing pin may be removed, and the firing pin of FIG. 6 may be replaced. This firing pin according to an embodiment of the present disclosure includes radii at all sharp shoulders to avoid stress concentrations and the associated failure point as seen in similar pins and as such is extremely tough and may have a longer life than a stock pin. A chamfer on the rear of the pin which is impacted by the hammer reduces the chance of out of battery firing and also serves the purpose of concentrating the impact of the hammer at the center of the pin. A firing pin according to an embodiment of the present disclosure may be re-profiled to have a circular impacting surface that moves the firing pin impact location on the rimfire cartridge case towards the center, inside of the rim for better ignition as opposed to a standard firing pin where much of the energy of the hammer strike is dissipated in crushing the outside of the rim rather than impacting the area containing priming compound. The circular pin profile may allow for a more consistent, deeper dent in the area of the rimfire case where the priming compound is, and less impact to the outside edge of the rim.

Figure 7:
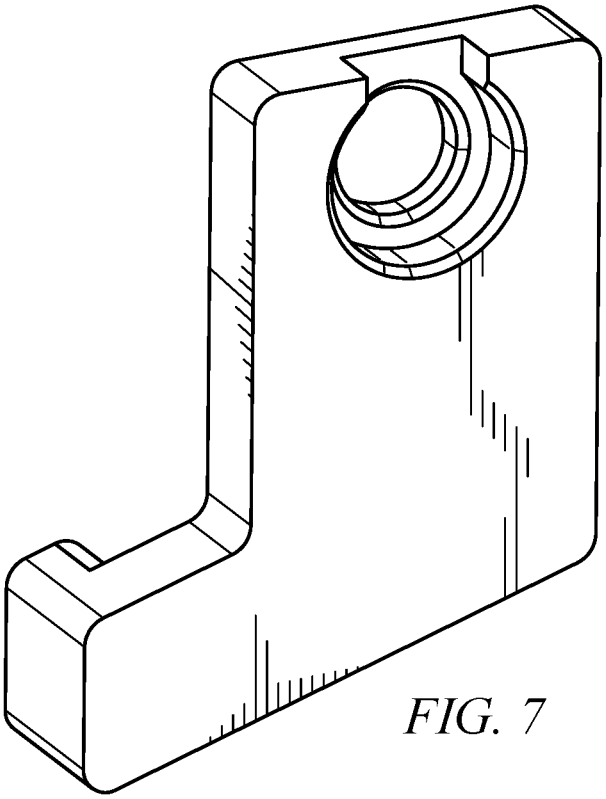
FIG. 7 depicts a bolt buffer according to an embodiment of the present disclosure.

FIG. 7 depicts a bolt buffer according to an embodiment of the present disclosure. The bolt buffer may install quickly and easily into the back plate of the bolt carrier group without bolt disassembly. The rod and spring may be compressed into the bolt spring housing, creating a gap between the rod end and the back plate. The end of the rod may be placed into the hole in the buffer, the tab may be aligned on the buffer with the cutout on the back plate, and the rod end may be placed into the hole in the back plate. The bolt buffer may include a hole that holds the spring guide rod, as well as a tab that may interface with the cutout on the backplate. This may allow for easy installation and replacement without tools and positive positioning during use. The bolt buffer according to an embodiment of the present disclosure may prevent metal on metal contact at the rear of the bolt stroke when firing, which may soften the impact of the bolt to the backplate, further reducing wear/damage to the lower receiver. It should be appreciated that there may be some kits that do not include a cutout on the back place, and in such cases, the tab on the bolt buffer may be clipped off. The bolt buffer may not automatically align with the upper receiver without the tab, and thus, care may be needed when replacing the bolt carrier assembly into the upper receiver to prevent binding from the buffer rotating.

A modified collar may be provided that can take a set screw to lock a chamber adapter into the collar, which may allow for a dedicated rimfire group to be used in a centerfire gun through a chamber adapter that can be inserted and locked in and removed for use in a dedicated rimfire rifle. It should be appreciated that some users may use the same bolt group with both a dedicated rifle and in a centerfire gun through the use of a chamber adapter. Rifling may be included in the adapter to increase accuracy and/or the bolt group may include both smoothbore and rifled versions in embodiments of the present disclosure. Utilizing a collar, the addition of a threaded hole (rather than a pressed-in ball spring plunger that is currently in use in some other collars) may allow for (1) the use of a chamber adapter that interfaces with and can be locked into a standard dedicated rimfire collar (rather than a monolithic piece combining chamber adapter and collar as currently embodied in other designs); and (2) the user to choose to use either the standard ball spring plunger retention on a dedicated rimfire barrel or the set screw to lock the collar to the barrel for a positive lock of bolt to barrel for those users who desire increased rigidity and positive location on the rimfire bolt group which may increase overall accuracy and reliability of the rifle with installed rimfire bolt.

Figure 11A:
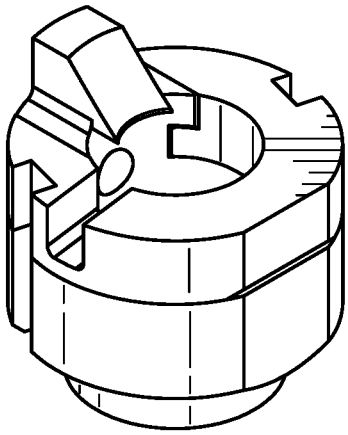
FIGS. 11A-11C depict a barrel collar according to an embodiment of the present disclosure.
Figure 11B:
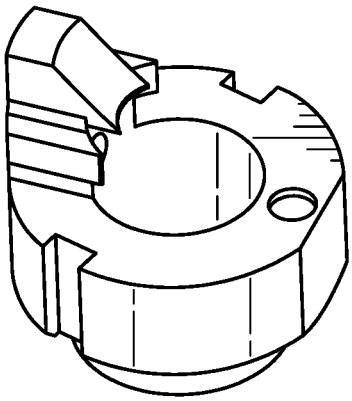
Figure 11C:
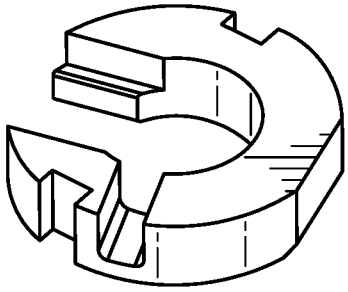

FIGS. 11A-11C depict a barrel collar according to an embodiment of the present disclosure. A barrel collar according to an embodiment of the present disclosure may prevent metal on metal impact between the bolt face and the barrel collar. A polymer buffer that is easily replaceable without tools may serve as the bolt impact point. The buffer may include tabs that slide into corresponding grooves on the steel collar and may be held in place vertically by a snap fit or another similar fastener. Once collar assembly is installed into the bolt rails, the buffer may be held in place to the collar by the tabs and snap fit as well as being held in place to both the collar and the rails by the rails which interface with both the collar and buffer. A polymer buffer may eliminate the noise of a metal-on-metal impact between the bolt and a standard collar, and also may absorb some of the impact energy of a bolt traveling forward into battery, reducing bolt bounce. The quieter operation is very desirable for users who are utilizing a suppressor, but all users, both with and without a suppressor, may benefit from reduced bolt bounce and a softer, smoother impact of the bolt closing and thus, reduced noise and harshness from the action cycling.

Although the present disclosure and its advantages have been described in detail, it should be understood that various changes, substitutions and alterations can be made herein without departing from the spirit and scope of the disclosure as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure, processes, machines, manufacture, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

The invention claimed is:

1. A firearm reliability system comprising:

a charging handle insert (CHI) paced in a charging handle of a bolt assembly of a rifle, wherein the CHI increases cycling reliability by preventing rimfire casings from getting caught in the charging handle of the rifle and by deflecting gas away from a shooter during firing of the rifle; and a variable bolt weight assembly (VBWA) placed in the bolt assembly under the charging handle and under a tubular recoil spring housing of the bolt assembly and that contacts a back of a bolt in the bolt assembly.

2. The firearm reliability system of claim 1, wherein the VBWA contacts the back of the bolt near a firing pin.

3. The firearm reliability system of claim 1, wherein the VBWA contacts the back of the bolt on a keyed area on a back of the tubular recoil spring housing.

4. The firearm reliability system of claim 1, wherein the rifle comprises a dedicated rimfire firearm.

5. The firearm reliability system of claim 1, wherein the rifle comprises a centerfire firearm with a chamber adapter style rimfire conversion kit installed.

6. The firearm reliability system of claim 4, wherein the charging handle is a centerfire charging handle (CCH), wherein the CHI fills a gas key channel in the CCH, to prevent malfunctions from empty rimfire casings that become lodged in the gas key channel.

7. The firearm reliability system of claim 1 further comprising:

a buffer pressure plug that increases cycling reliability by applying steady forward pressure to a back plate of a rimfire bolt carrier, bolt, and chamber adapter assembly; and a buffer spring, wherein the buffer pressure plug compresses the buffer spring to add extra pressure to the back plate of the rimfire bolt carrier, bolt, and chamber adapter assembly.

8. The firearm reliability system of claim 7, the buffer pressure plug further comprising:

a retention slot in which a buffer pin rests to keep the buffer pressure plug aligned; and an insertion slot disposed along a length of a cylinder of the buffer pressure plug, the insertion slot being aligned with the buffer pin and pushed straight rearward to insert.

9. The firearm reliability system of claim 1 further comprising:

a bolt buffer including a hole that receives a spring guide rod and a tab that interfaces with a cutout on the back plate of the rimfire bolt carrier, bolt, and chamber adapter assembly.

10. The firearm reliability system of claim 1 further comprising:

a modified collar that locks a chamber adapter into the modified collar, thereby allowing a dedicated rimfire group to be used in a centerfire gun through the chamber adapter that is inserted and locked in and removed for use in the rifle, wherein the rifle is a dedicated rimfire rifle.

11. The firearm reliability system of claim 1 further comprising:

a polymer buffer that serves as a bolt impact point, the polymer buffer including tabs that slide into corresponding grooves on a collar, wherein the polymer buffer eliminates noise of metal-on-metal between the bolt and the collar.

12. The firearm reliability system of claim 1, the CCH comprising:

a semi-cylindrical lower profile that matches a semi-cylindrical profile of a gas key channel of the charging handle;

gas deflection cutouts that redirect gas from an open gas tube and block an open channel leading back toward a shooter; and a center channel that retains the CHI inside of the charging handle.

13. The firearm reliability system of claim 12, the CHI further comprising:

retention ramps on either side of the center channel to enhance friction between the CHI and walls of the gas key channel of the charging handle.

14. The firearm reliability system of claim 12, wherein in a conversion kit configuration in a centerfire rifle, a gas tube connects to a rifle's bore forward of a chamber and interfaces a centerfire bolt group to cycle the action by utilizing high pressure gas from behind a bullet during firing.

15. The firearm reliability system of claim 12, wherein in a centerfire configuration, high pressure gas unlocks bolt and pushes the bolt rearward to cycle action.

16. The firearm reliability system of claim 12, wherein in a rimfire conversion configuration, a gas tube is connected to a rifle bore and high-pressure gas is bled off but is not used to cycle the rifle.

17. The firearm reliability system of claim 1, wherein a weight body of the VBWA is behind the bolt as it closes to eliminate bolt bounce with two impacts.

18. The firearm reliability system of claim 17, wherein the two impacts are the weight body to the rearward moving bolt and internal weights of the VBWA to the rearward moving bolt and a bolt body.

19. The firearm reliability system of claim 17, wherein the back of the bolt includes a notch that engages a notch present on the spring guide rod extension of the bolt assembly.

20. The firearm reliability system of claim 17, wherein the VBWA contacts the back of the bolt near a firing pin and/or the VBWA contacts the back of the bolt on a keyed area on a back of the spring guide rod extension.

* * * * *